United States Patent [19]

Struckmeyer

[11] 4,337,597

[45] Jul. 6, 1982

[54] SLIDING WINDOW CONSTRUCTION HAVING PIVOTAL CHARACTERISTIC TO FACILITATE CLEANING BOTH SIDES OF THE WINDOW

[76] Inventor: Ernest F. Struckmeyer, 1261 S. Mayfair, Daly City, Calif. 94015

[21] Appl. No.: 138,235

[22] Filed: Apr. 7, 1980

[51] Int. Cl.[3] ..... E05F 7/02

[52] U.S. Cl. ..... 49/256; 49/174; 49/321

[58] Field of Search ..... 49/162, 163, 164, 174, 49/175, 176, 255, 254, 256, 257, 258, 453–457, 409, 321

[56] References Cited

U.S. PATENT DOCUMENTS

| | | | |
|---|---|---|---|
| 1,713,831 | 5/1929 | Ishaner et al. | 49/174 |
| 3,041,680 | 7/1962 | Gurniak | 49/257 X |
| 3,188,699 | 6/1965 | Walters | 49/177 X |

*Primary Examiner*—Kenneth Downey

*Attorney, Agent, or Firm*—John J. Leavitt

[57] ABSTRACT

Presented is a window construction of the sliding window type that includes one or more panes slidable to open or close the window opening, each of the panes being pivotal in addition to being slidable to provide access to both sides of the window pane to facilitate cleaning of both sides of the glass pane from the inside of the room.

4 Claims, 10 Drawing Figures

SLIDING WINDOW CONSTRUCTION HAVING PIVOTAL CHARACTERISTIC TO FACILITATE CLEANING BOTH SIDES OF THE WINDOW

BACKGROUND OF THE INVENTION

1. Field of the Invention

This invention relates to sliding glass windows, and more particularly to a sliding glass window incorporating means for effecting pivotal movement of the glass window pane out of the plane in which the pane is slidable so as to facilitate cleaning of both sides of the window glass.

2. Description of the Prior Art

The art pertaining to this invention is believed contained in Class 49, sub-classes 67, 143, 145, 149, 161, 162, 177, 183 382 and 388.

A search through this field of search has revealed U.S. Pat. Nos. 2,702,414 and 2,310,312. U.S. Pat. No. 2,702,414 relates to the placement of an inside storm window for use in conjunction with a casement type window that pivots outwardly to open. The inside mounted storm window is constructed in two parts, namely, a pivoted section and a slidable section. When the slidable section is interconnected with the pivoted section, a seal is formed at the union between the two sections and the window can be locked from the inside. The pivoted storm window section is not slidable, nor is the slidable section pivotal. U.S. Pat. No. 2,310,312 relates to a vertically slidable double-hung sash window each of the main frames of which have an inner auxiliary frame that is glazed and which is pivoted around a vertical pivotal axis on the main frame. The window is not slidable. The mechanism for effecting pivotal movement of each of the inner glazed frames constitutes a worm and pinion mechanism rotated by a knob on the end of a special key.

The subject matter of my invention differs significantly from the structures of the two patents noted above in that each of the window panes forming the window is separately and individually slidable within a main frame from a closed condition to an open condition, in much the same manner as a conventional sliding glass window. Thus, each of the window panes may be locked in the usual manner. Additionally, means are provided in association with each of the window panes to effect disengagement of each of the window panes from the longitudinal tracks in which they normally slide to convert each of the window panes into a pivotally mounted window pane pivotal about a vertical axis so as to provide access to both sides of the window pane for cleaning purposes. Accordingly, it is one of the important objects of the invention to provide a window construction including one or more glass panes or lights which in one aspect are slidable to effect opening and closing of the window opening, and which in another aspect may be converted to permit pivotal movement of the separate window panes about a vertical axis.

Another object of the invention is the provision of means for shifting the window panes vertically while retained in plane in which they normally slide so as to release the window panes from structure normally retaining them in the plane in which they slide while suspending the window panes for pivotal displacement about a vertical axis.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the subject matter of this invention comprises a main window frame enclosing one or more slidable window panes or lights, each of the window panes having a separate frame slidably engageable in the main frame to permit transverse movement of each window pane within the main frame along appropriate tracks or guide channels. Additionally, means are provided associated with the main frame for converting the slidable window panes into pivotal window panes so as to permit pivotal reorientation of the window panes from the plane of the main window frame to a plain substantially perpendicular thereto. Such means include appropriate cams digitally manipulable to retract the guide channels within which the window panes normally slide so as to disengage the window panes therefrom.

DESCRIPTION OF THE PREFERRED EMBODIMENT

Figure 1:
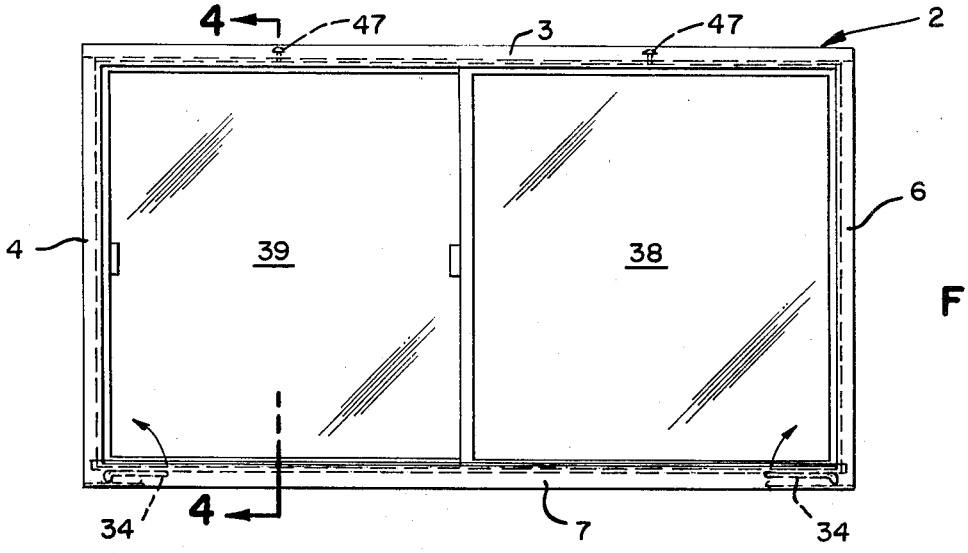
FIG. 1 is a front elevational view of a window incorporating my invention, showing both window panes in closed condition.
Figure 2:
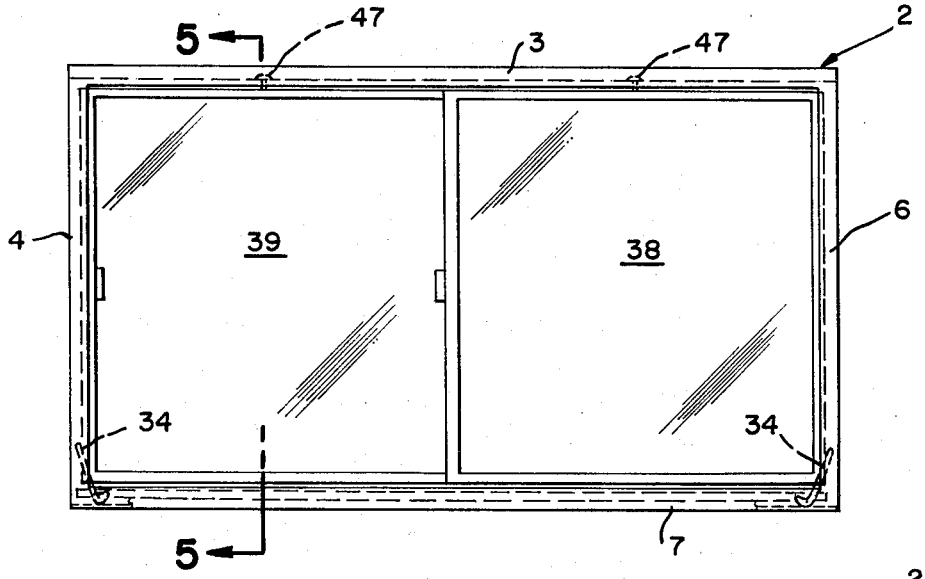
FIG. 2 is a view similar to FIG. 1 but showing the separate window panes disengaged from the slide channels in which they normally are guided.
Figure 3:
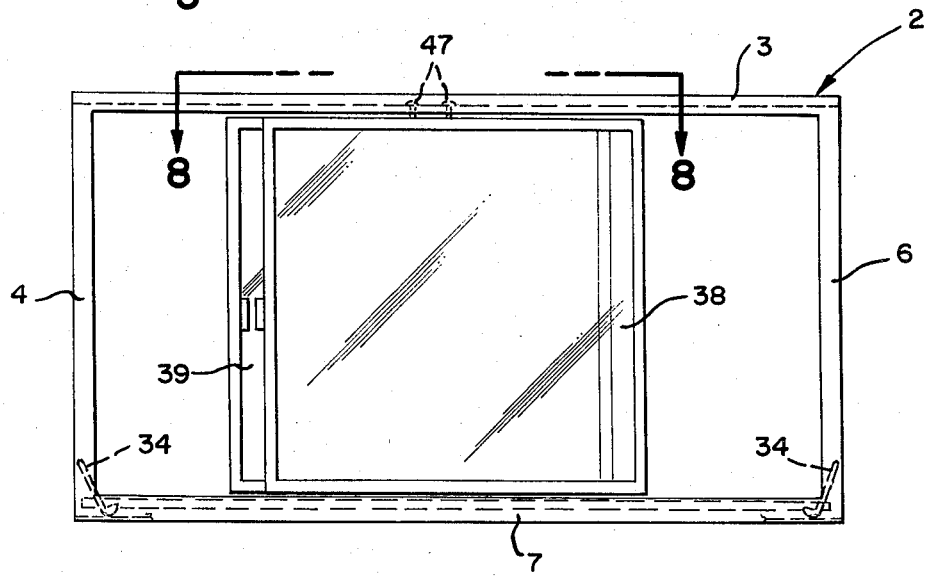
FIG. 3 is a front elevational view showing the two separate window panes repositioned in preparation for pivotal movement into a plane angularly disposed to the plane of the main window frame.

In terms of greater detail, the sliding and pivotal window construction of the invention comprises a main window frame designated generally by the numeral 2 and comprising a channel, conveniently fabricated from aluminum or other appropriate material, and suitably secured in a rough opening of a building wall to frame the opening within which one or more window panes or lights are appropriately mounted. As illustrated in FIGS. 1, 2 and 3, the main frame 2 comprises an upper channel member 3, left and right channel members 4 and 6, respectively, and a lower channel member 7, all being integrated in a common plane and having their respective mutually engaging ends appropriately secured to form a generally rectangular main frame adapted to be permanently secured in the rough opening of the building by trim pieces 8 and 9 appropriately secured so as to lock the main frame in immovable position.

Figure 4:
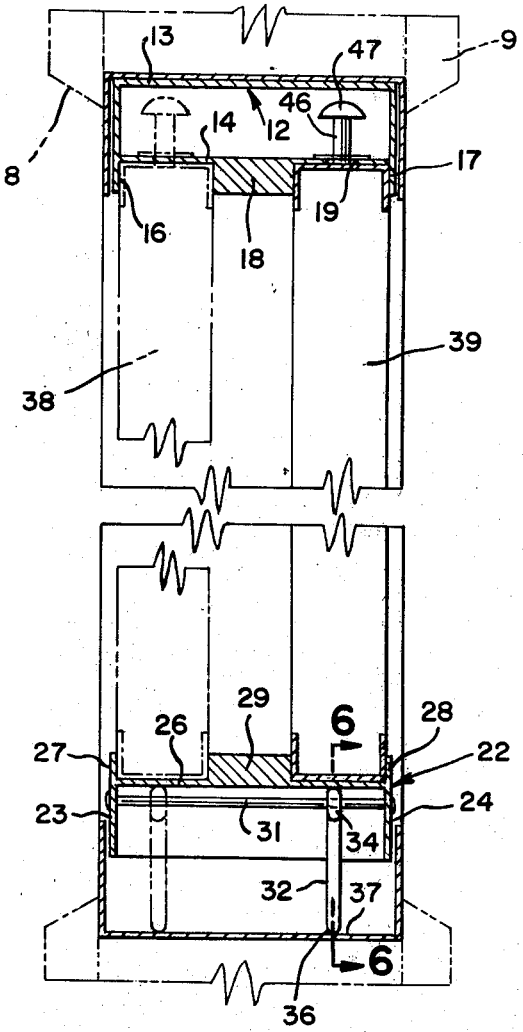
FIG. 4 is a vertical cross-sectional view taken in the plane indicated by the line 4—4 in FIG. 1.
Figure 5:
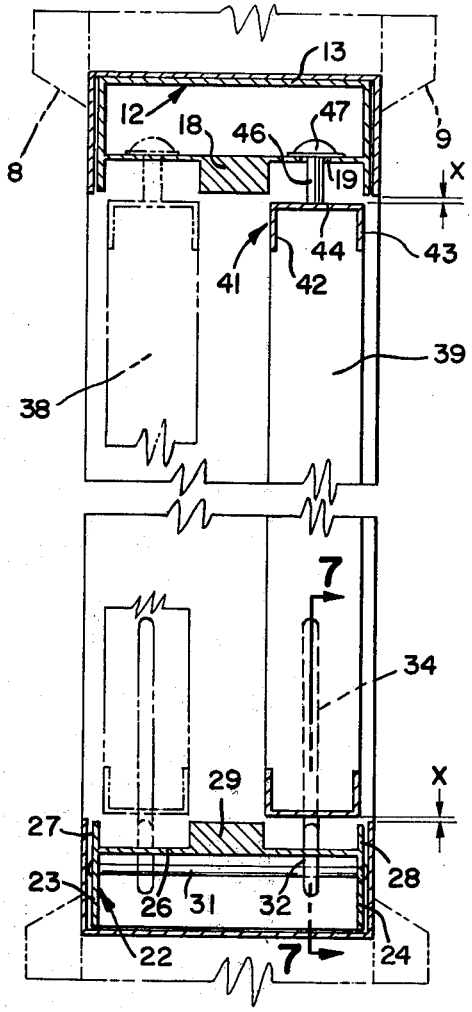
FIG. 5 is a vertical cross-sectional view taken in the plane indicated by the line 5—5 in FIG. 2.
Figure 8:
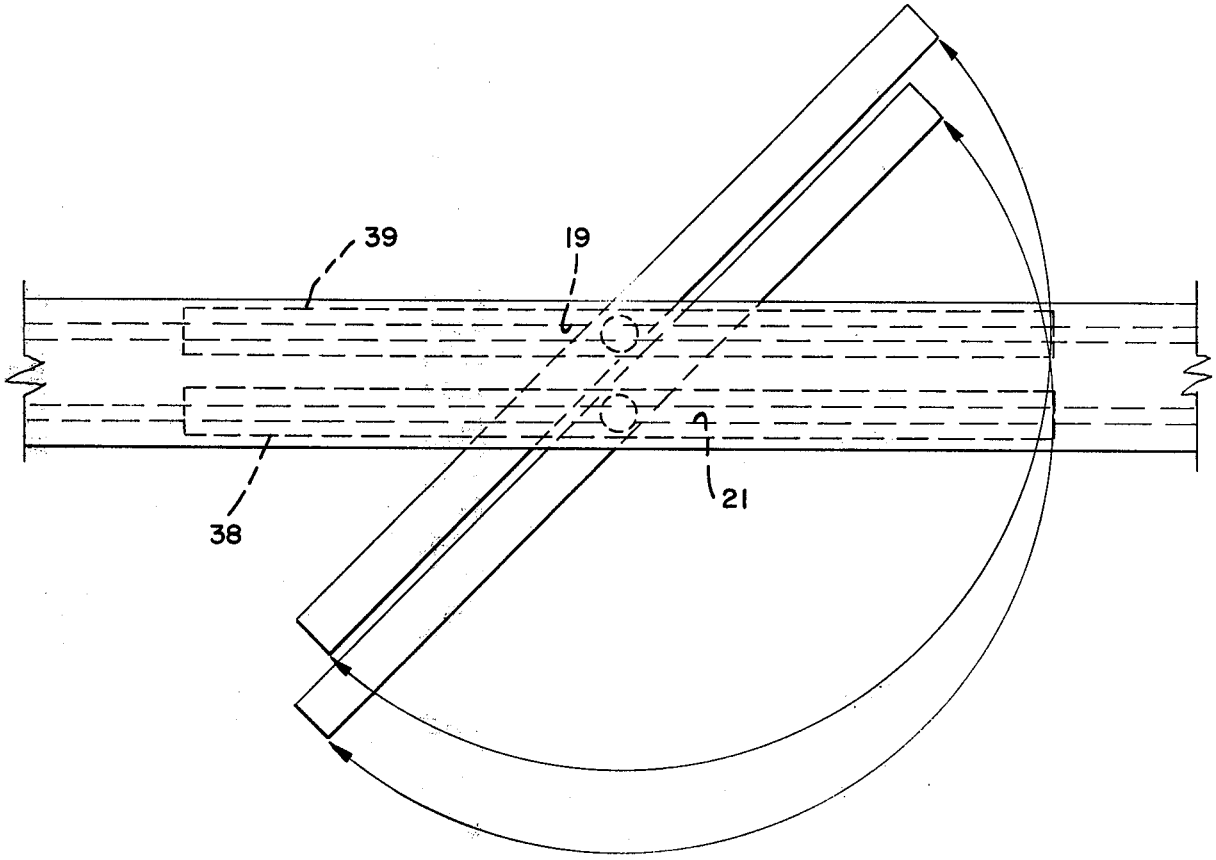
FIG. 8 is a plan view illustrating the pivotal displacement of both window panes out of the plane of the main window frame.

Within the upper channel 3 of the main frame, there is appropriately secured by any suitable means such as screws (not shown) an elongated guide member designated generally by the numeral 12 and including a box section the upper wall 13 of which is fastened to the main frame 2 while the lower wall 14 is provided with integral downwardly projecting channel flanges 16 and 17 and a strengthening rib 18 centrally positioned between the two side flanges 16 and 17 so as to rigidify the guide member and divide the space therebetween into two parallel and juxtaposed tracks or channels within each of which a separate window pane is received. The lower wall 14, as illustrated in FIGS. 4, 5 and 8, is provided with elongated slots 19 and 21 which extend longitudinally generally from about the mid-point of the adjacent window pane so as to permit each window pane to have a full excursion from one end of the main frame to the other.

Mounted in the lower main frame channel 7 as illustrated in FIGS. 4, 5, 6 and 7, is an elongated extruded member designated generally by the numeral 22 conveniently of H-shaped cross-section and including side webs 23 and 24 joined by a transversely extending web 26 spaced between opposite ends of the side members 23 and 24 so as to provide upwardly extending flanges 27 and 28 which cooperate with central rib 29 to define two spaced tracks or channels within which a window pane may be confined. The width of elongated extruded member 22 is proportioned to fit snugly within the main frame channel while permitting slidable displacement thereof in a vertical plane.

Pivotally mounted on the elongated extruded member 22 adjacent each opposite end thereof is a cam assembly including a pivot pin 31 suitably journaled in the side members 23 and 24 of the elongated extruded member 22, each of the pins 31 adjacent each opposite end having mounted thereon a pair of cam members including a lobe portion 32 having a cam surface 33 thereon and an elongated handle portion 34 adapted to be digitally manipulated to pivot the cam lobe portion 32 so that the cam surface 33 bears against the inner surface of the main frame channels 7. As viewed in FIG. 6, the cam lobe portion has been pivoted so that the handle extends horizontally and the apex 36 of the cam lobe 32 bears against the lower web surface 37 of main frame channel 7.

Figure 7:
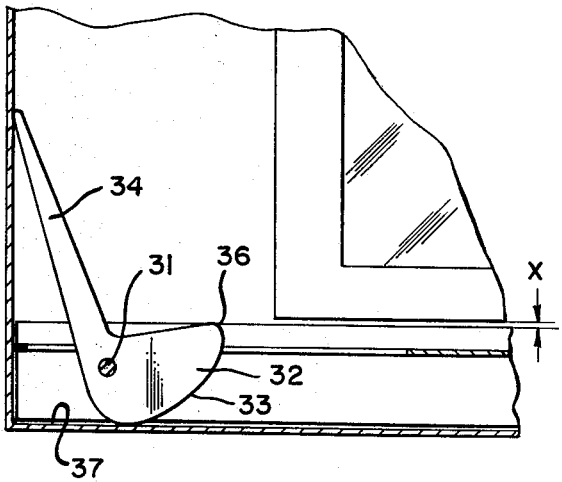
FIG. 7 is a fragmentary sectional view taken in the plane of the line 7—7 in FIG. 5 and illustrating the cam mechanism shifted to effect disengagement of the window panes by the guiding channels.

The effect is to cause the pin 31 which is journaled in the elongated extruded member 22 to be elevated so that the entire extruded elongated member 22 is also elevated uniformly into its uppermost position to support and form a guide for the window panes assembled therein. In FIG. 7, it will be seen that the cam member has been pivoted so as to effect a lowering of the elongated extruded member 22 so that the lower edges of the side members 23 and 24 impinge on the surface 37 and the channels formed by the flanges 27 and 28 and the central rib 29 are now positioned in their lowermost position.

Normally confined along their upper edges in each of the channels defined by the flanges 16 and 17 and the central rib 18 are separate window panes designated generally by the numerals 38 and 39. Each of the window panes is provided with a peripheral frame designated generally by the numeral 41, conveniently fabricated from an appropriate metal such as aluminum or other appropriate material, the frame being provided with peripheral flanges 42 and 43 that encase the peripheral side edge portions of the glass panes, and a bottom web 44 that encases the peripheral edge of each of the panes. As illustrated in FIGS. 4 and 5, the upper portion of each of the peripheral channel frames 41 that encloses the glass pane is provided with an upwardly projecting stud 46 the lower end of which is securely fastened to the bottom wall 44 of the peripheral channel and the upper end of which is provided with a head 47. The upwardly extending stud 46 projects through the associated slot 19 or 21, and the head 47 is adapted to bear upon the bottom wall 14 of the upper box section 12 when the pane with which it is associated is lowered into its lower most position by the withdrawal or retraction of the supporting lower elongated H-shaped member 22.

Figure 6:
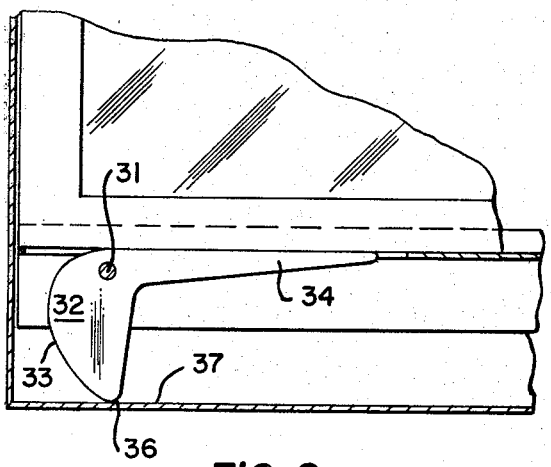
FIG. 6 is an enlarged fragmentary sectional view taken in the plane indicated by the line 6—6 in FIG. 4 and illustrating the cam mechanism in position to elevate the window panes and support the slide channel in engagement with the associated elevated window panes.

Thus, referring to the embodiment of the invention illustrated in FIGS. 1 through 7, when the cam member is in the position illustrated in FIG. 6, the elongated extruded member 22 bears against and supports the lower edge portion of each of the window panes 38 and 39 so that the upper and lower peripheral portions of each window pane are slidably engaged in the associated channels provided by the upper and lower elongated members 12 and 22, respectively.

As viewed in FIG. 7, when the cam member is pivoted so as to lower the elongated member 22 associated with the main frame channel 7, the elongated member 22 is retracted into its lowermost position, thus removing the support from the lower edge of the window panes 38 and 39, causing these to move downwardly for a distance equal to the length of the stud 46, whereupon the head 47 on the free end of the stud comes to rest against the bottom web 14 of the box section 12, and disengaging the upper edge of the pane from the confining channel, thus pivotally suspending the window panes 38 and 39 thereon. Continued downward movement of the elongated member 22 progresses until the flanges 27 and 28, and the intermediate rib 29 become disassociated from the lower peripheral edge portion of the associated window panes by a distance X (FIGS. 5 and 7) that permits each of the individual window panes 38 and 39 to be pivoted about the vertical axis of the studs 46, to thus position each window pane in the angularly disposed position illustrated in FIG. 8. With the window panes 38 and 39 thus released from the confining upper and lower channels, the window panes may be angularly displaced as illustrated in FIG. 8, and may also be transversely moved individually in the associated slots 19 and 21 so as to provide sufficient space between the separate window panes to permit cleaning of both sides of each window pane from the inside of the room for which the window is provided. While I have illustrated and described the incorporation of studs 46 only in association with the upper edge of each pane, it should be apparent that similar studs may be associated with the lower edges of the panes.

When it is desired to again convert the window to a slidable window, all that is required is that the window panes 38 and 39 be re-aligned in the plane of the channels in which they are normally confined for slidable movement, and the cam members at each end pivoted downwardly from the position illustrated in FIG. 6. As the cam members are pivoted, the lower channel is elevated into engagement with the lower edges of the window panes 38 and 39. Continued pivotal movement of the cam members elevates not only the lower elongated channel member 22 but also the window panes supported thereon, with each of the window panes moving upwardly until the upper edges thereof are confined within the channels formed by the downwardly depending flanges 16 and 17 and the intermediate rib member 18 of the upper elongated member 12. The individual window panes 38 and 39 may now be operated in conventional manner, being slidable from one end of the main frame to the other to open or close the opening formed by the main window frame.

In the embodiment illustrated in FIGS. 6 and 7, particularly FIG. 6, it should be noted that when the lower elongated channel member 22 is elevated so as to confine the window panes, and the cam members are in the position illustrated in FIG. 6, the elongated handle portion 34 of the cam member is covered by or underlies the associated window pane. Thus, when the window is locked, there is no way for an intruder to manipulate the cam members so as to lower the elongated channel member 22 and thus enable pivotal movement of the window panes. To initiate movement of each cam member and pivotal movement of the cam portion 34 into the position illustrated in FIG. 7, it is necessary that the conventional locking mechanism for the window panes be unlatched and that the window panes be displaced along the channel for a distance sufficient to give access to the handle portion 34 of each cam member.

Figure 9:
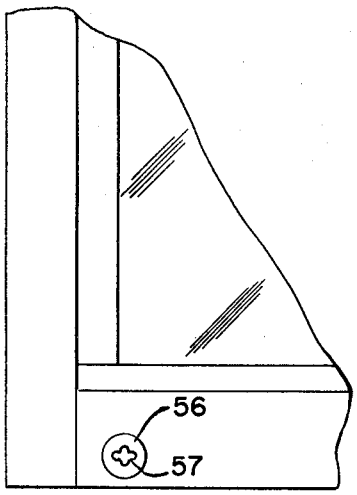
FIG. 9 is a fragmentary elevational view illustrating a key hole adapted for operating the cam mechanism.
Figure 10:
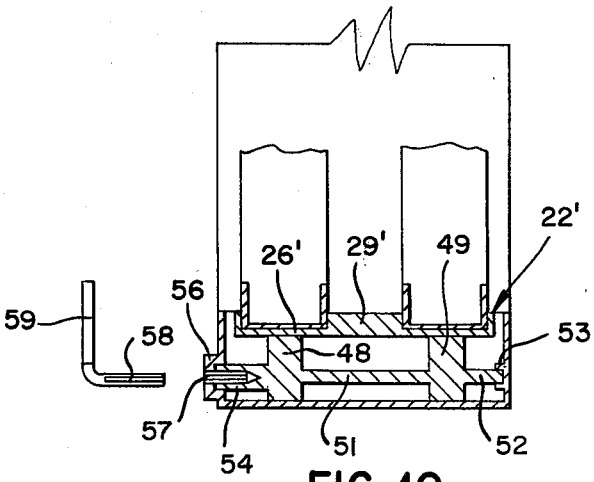
FIG. 10 is a vertical cross-sectional view of the cam mechanism illustrated in FIG. 9, this structure constituting an alternate embodiment to the cam mechanism illustrated in FIGS. 6 and 7.

The embodiment illustrated in FIGS. 9 and 10 is similar to the embodiment illustrated in FIGS. 1 through 7, with the exception that the cam structure has been modified to permit operation with a key from the inside of the room in which the window is installed. Thus, in this embodiment, a pair of cams 48 and 49 are provided, each mounted adjacent opposite ends of the main window frame on a pivot pin 51 one end portion 52 of which is rotatably journaled in a bearing member 53 on the main frame while the opposite end portion 54 is appropriately journaled in a bearing projection 56 of the main frame. The portion 54 of the pin 51 is provided with a socket 57 having appropriate lands and grooves that complement lands and grooves formed on the operating end 58 of a key 59. Thus, by inserting the key portion 58 in the socket 57 adjacent each end of the main window frame, the cams 48 and 49 may be rotated to effect raising and lowering of the elongated extruded channel member 22 as previously described. In all other respects, the embodiment illustrated in FIGS. 9 and 10 operates in the same manner as the embodiment illustrated in FIGS. 1 through 7 and, in the interest of brevity, primed reference numbers have been applied in FIGS. 9 and 10 where appropriate.

Having thus described the invention, what is claimed to be new and novel and sought to be protected by Letters Patent of the United States is as follows:

1. A window construction having one or more window panes adapted for normally slidable transverse movement to effect opening and closing of said window panes of each window pane about a vertical axis so as to permit cleaning of both sides of each window pane from the inside of the room in which the window construction is installed, the combination comprising:

(a) a main window frame adapted to be fixed within an opening in a wall to frame said opening and provide support for one or more window panes adapted to be mounted therein;

(b) at least one window pane normally slidably mounted on said main window frame in an elevated position for selective transverse slidable movement in the plane of said main window frame; and (c) means interposed between said window pane and said main window frame normally supporting said window pane in said elevated position and selectively operable to lower said window pane to a lower position in which said window pane is pivotally suspended in the opening formed by said main window frame whereby said window pane may be pivoted out of the plane of said main window frame to give access to both sides of the window pane.

2. The combination according to claim 1, in which said means interposed between said window pane and said main window frame includes an elongated member underlying said window pane and selectively movable vertically in relation to said main frame and said window pane and defining a guide normally slidably engageable by said window pane to confine said window pane during slidable movement therealong when said elongated member and said window pane are in elevated position, and means interposed between said elongated member and said main window frame selectively operable to lower said elongated member to effect selective disengagement of said elongated member from said window pane to free said window pane for pivotal movement out of the plane of said main window frame.

3. The combination according to claim 1, in which said means interposed between said window pane and said main window frame includes means on the top edge of said window pane normally slidably engaging said main window frame and selectively pivotally suspending said window pane in said opening when said window pane is in said lower position.

4. The combination according to claim 1, in which said means interposed between said window pane and said main window frame selectively operable to pivotally suspend said window pane includes an upper main window frame header member comprising a channel having a longitudinal slot in the base thereof, a stud having a head thereon secured to the top of the window pane on its central vertical axis and slidable in said slot for guiding the top of the panel when the panel is suspended from said headed stud, a lower elongated member forming a guide normally slidably engaging the lower edge portion of said window pane when in elevated position to confine said window pane during slidable movement thereof, and cam means operatively interposed between said main window frame and said lower elongated member and selectively operable to retract said lower elongated member to disengage said window pane to free said window pane for pivotal movement about said stud out of the plane of said main window frame.

* * * * *